US005346084A

United States Patent [19]

Jurgevich

[11] Patent Number: 5,346,084

[45] Date of Patent: Sep. 13, 1994

[54] INTERMODAL CONTAINER WITH INTEGRATED INTERBOX CONNECTORS

[75] Inventor: Howard J. Jurgevich, Monticello, Ind.

[73] Assignee: Rosby Corporation, Monon, Ind.

[21] Appl. No.: 49,838

[22] Filed: Apr. 19, 1993

[51] Int. Cl.[5] ..... B65D 7/26; B65D 21/02

[52] U.S. Cl. ..... 220/1.5; 206/511; 206/512

[58] Field of Search ..... 220/1.5; 206/506, 512, 206/511

[56] References Cited

U.S. PATENT DOCUMENTS

| | | | |
|---|---|---|---|
| 3,011,749 | 12/1961 | Kozak | 206/512 |
| 3,083,670 | 4/1963 | Harlander et al. | 206/512 |
| 3,085,707 | 4/1963 | Tantlinger | 206/512 |
| 3,752,511 | 8/1973 | Racy | 206/512 |
| 3,973,684 | 8/1976 | De Martino | 206/512 |
| 4,186,841 | 2/1980 | Buckley et al. | 206/512 |
| 4,648,764 | 3/1987 | Pavlick | 206/512 |
| 5,014,867 | 5/1991 | Van Melle | 206/512 |
| 5,022,546 | 6/1991 | Bock | 206/512 |

*Primary Examiner*—Joseph Man-Fu Moy
*Attorney, Agent, or Firm*—Locke Reynolds Boyd & Weisell

[57] ABSTRACT

Apparatus for engaging interlocking apertures provided on the bottom of intermodal cargo containers to permit vertical stacking of the containers. The apparatus is in the form of integrated interbox connectors movably connected to the containers and positionable between in a stored position situated within the walls of the container and a connecting position situated on top of the roof of the container to engage the interlocking apertures of a vertically adjacent container. A pin is provided for securing the interbox connectors situated in the connecting position to said interlocking apertures provided on the bottom of said vertically adjacent container.

22 Claims, 8 Drawing Sheets

INTERMODAL CONTAINER WITH INTEGRATED INTERBOX CONNECTORS

BACKGROUND OF THE INVENTION

The present invention relates to cargo carrying containers suitable for use in multi-mode transportation of freight or cargo by ship, rail, or overland truck. Examples of intermodal cargo containers are found in U.S. Pat. No. 3,085,707; 3,646,609; 4,212,405; 4,844,672; and, 5,205,428.

Intermodal cargo containers generally are constructed to certain standard dimensions and have structural features that minimize handling problems and allow for the stacking of containers, particularly when used in a ship or rail mode. Certain changes in overall width, length and height have been adopted from time-to-time for certain newer style containers, but such changes in overall dimension have only been made in such a manner to accommodate stacking arrangements with older style containers. For example, the intermodal containers constructed as disclosed in U.S. Pat. No. 3,085,707 were built at a standard length of 40 feet. The containers of U.S. Pat. No. 3,646,609 were intended to be longer than 40 feet in length, but were fitted on top and bottom with an intermediate set of castings which are connected together with a structural frame to allow the longer containers to be stacked and lifted at these intermediate points. The required thickness of the floor of the container necessary to bear the load is generally sufficient to enclose the castings which are employed on the bottom of the container for stacking purposes. On the other hand, the intermediate castings which are situated at the top of the containers as disclosed in U.S. Pat. No. 3,646,609 are considerably larger than either the thickness of the wall or roof and thus intrude into the cargo area of the container. This intrusion into the cargo area of the intermediate top castings has many disadvantages, and attempts have been made to reduce or eliminate this intrusion.

Certain newer containers which have sought to maximize the inside height, such as that disclosed in U.S. Pat. No. 5,205,428, have avoided this intrusion by eliminating the intermediate top casting which would permit stacking and replaced it with a side lift design intended to interact with either pin or wedge type handling devices. Such handling devices still maintain the existing lifting locations at the 40 foot apart intermediate lift points of the containers, but do not permit stacking at these locations. As such, these units can generally only be included in a stack of containers as the top unit thus reducing the flexibility of the unit and creating certain logistics problems for operators of intermodal container terminals.

One means of solving this problem is to create a stacking frame at each extreme end of the container and install conventional stacking castings to allow interlocking of the units together using conventional interbox connectors. However, when this is done, the stacking castings again intrude into the top of the cargo area at the front and rear corners. Such intrusion has the effect of reducing the usable inside length of such a container by as much as 12 inches which is not desirable. The present invention is an alternative solution which avoids any substantial intrusion into the enclosed cargo area while at the same time permitting the container to be situated at any point in a stack of longer containers.

SUMMARY OF THE INVENTION

An intermodal cargo container of the present invention comprises generally a space enclosing structure including a floor, a roof, a pair of parallel side walls, and first and second end walls, respectively, connected between the side walls, with at least one of either of the side walls or end walls defining an opening to permit entry and exit of cargo. The intermodal container further comprises integrated interbox connectors movably connected to the container and positionable in either a stored position situated within the space enclosing structure of the container or a connecting position situated on top of the roof of the container. The intermodal cargo container also comprises securing means for securing the interbox connectors in the stored position which are also employed to secure the interbox connectors to a vertically adjacent container when the interbox connectors are situated in the connecting position.

In the preferred embodiment, the integrated interbox connectors each comprise a plate movably connected to the intermodal cargo container. A positioning opening is provided in the roof of the container and a positioning lug is fixed to the movable plate to be received in the positioning opening to define a connecting position for the plate when situated on top of the roof of the container. A projecting lug is fixed to an opposite side of the plate and adapted to project upward into a confronting interlocking aperture of a vertically adjacent container when the plate is in the connecting position. At least one opening is provided in the projecting lug. A pin is insertable through an opening in a vertically adjacent container and into one of the openings in the projecting lug for securing the projecting lug to the interlocking aperture provided on the bottom of the vertically adjacent container. A chamber is provided in the walls of the container for receiving the positioning lug and the plate when moved to the stored position. The pin used to secure the projecting lug to the interlocking aperture can be employed to lock the projecting lug in a stored position within the container wall.

Preferably, the plate of the integrated interbox connector is pivoted to the container by hinge elements fixed to the plate and container and a hinge pin coupling the hinge elements together. Thus, the integrated interbox connectors are retractable and self-contained within the external geometry of the container yet have the advantage of being designed to retract in such a manner as to minimize the loss of inside length while providing no cargo area intrusion. A further advantage of this design is that the interbox connectors can no longer be lost or stolen when not in use which is common with current apparatus which utilizes separate loose interbox connectors which are typically stored in open containers on the rail car or at the intermodal container terminal. The integrated interbox connectors of the present invention have the added advantage of being less heavy to handle and also cannot drop or fall from the top of a container thus reducing the hazard to handlers of such containers.

Other features and advantages of the present invention will become apparent to those skilled in the art upon consideration of the following detailed description of a preferred embodiment exemplifying the best mode of carrying out the invention as presently perceived. The detailed description particularly refers to the accompanying figures.

DESCRIPTION OF THE PREFERRED EMBODIMENT

Figure 1:
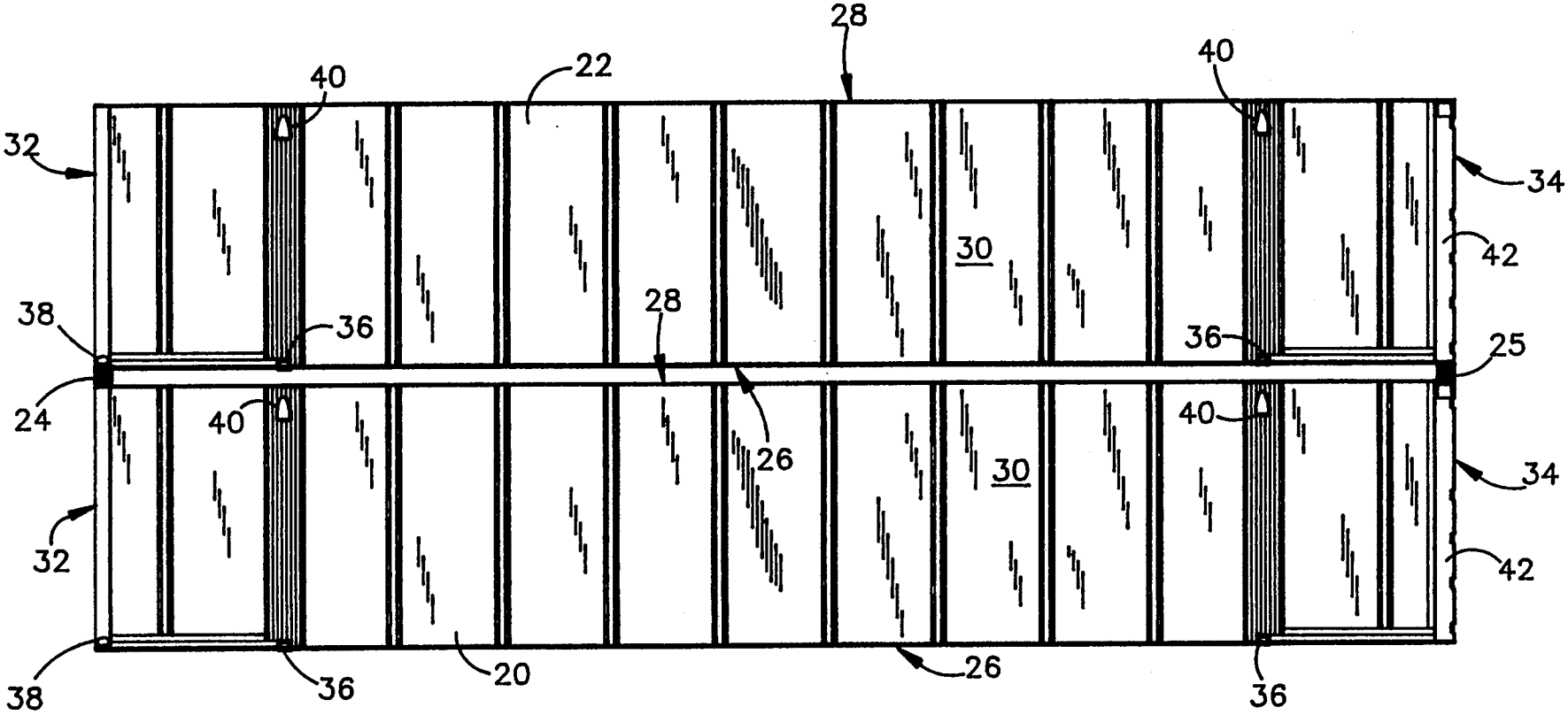
FIG. 1 is a side elevational view showing two containers, stacked one on the other, employing the integrated interbox connectors of the present invention.
Figure 3:
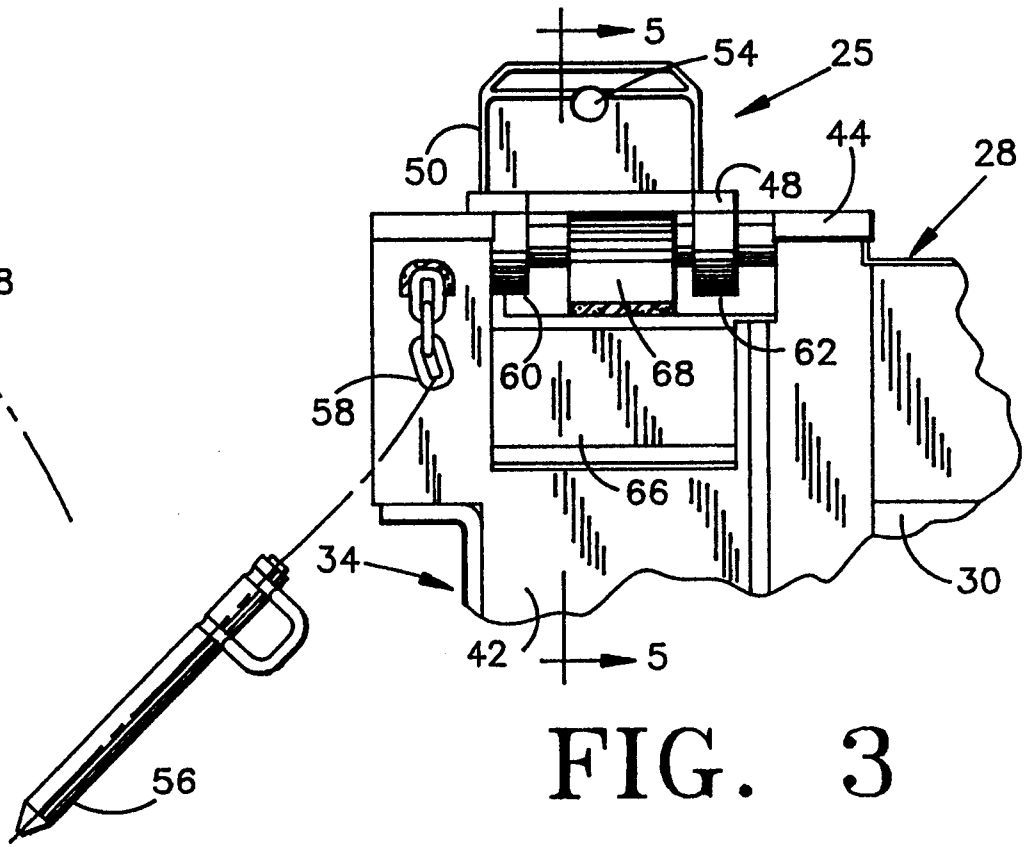
FIG. 3 is a side elevation view of the right side of FIG. 2.
Figure 2:
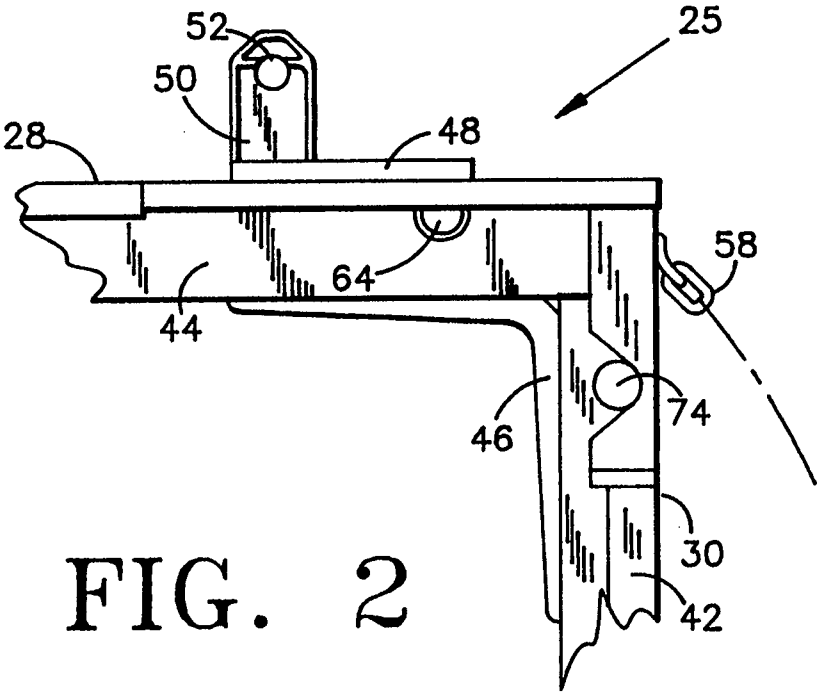
FIG. 2 is an elevation view of the upper right corner of the rear and of an intermodal cargo container incorporating an integrated interbox connector of the present invention.

Two intermodal cargo containers 20 and 22 are shown in FIG. 1 stacked together employing the integrated interbox connectors 24 and 25 of the present invention. Each of the intermodal cargo containers 20 and 22 comprises a space enclosing structure which includes a floor 26, a roof 28 and parallel side walls 30. The containers 20 and 22 include a front end 32 and a rear end 34. The rear end 34 includes an opening to permit entry and exit of cargo, the opening being secured by doors (not shown).

Stacking/interlocking apertures 36 are provided in the floor 26 of the containers 20 and 22 to permit stacking of the containers with conventional 40 foot length containers, or similar structures spaced at the conventional 40 foot distance. Chassis interlocking castings having apertures 38 are provided in the outermost corners of the floor 26 to permit locking of the container to a wheeled chassis for transportation in a truck mode.

Side top lifting apertures 40 are provided to receive pin or wedge type lift elements for lifting the intermodal cargo containers to permit assembly and disassembly of the various transportation mode schemes. The integrated interbox connectors 24 and 25 of the present invention are shown in FIG. 1 to cooperate with downwardly facing openings included in the chassis interlocking castings at the lower corners of the container 22.

FIGS. 2–6 detail the preferred structure for an integrated interbox connector 25 of the present invention used on the rear end 34 of the container. A rear corner post 42 extends from the floor 26 to the roof 28 of the container and is joined to the top rear header 44. An L-shaped bracket 46 reinforces the connection between the rear corner post 42 and top rear header 44.

Figure 6:
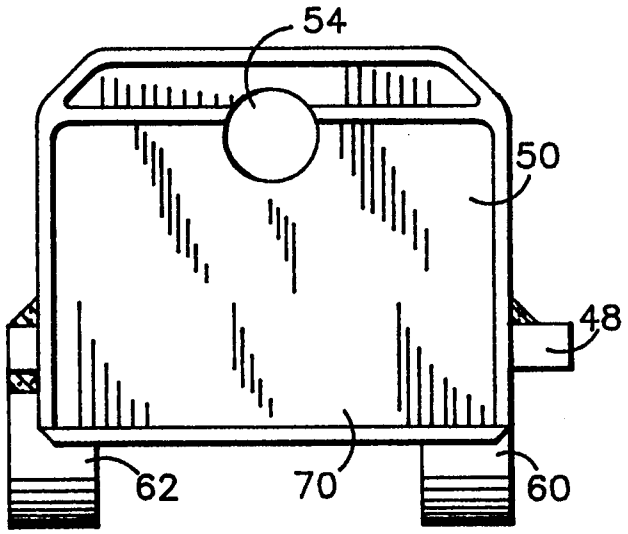
FIG. 6 is a side elevation view of the interbox connector weldment viewed from the opposite side of the view shown in FIG. 3.
Figure 4:
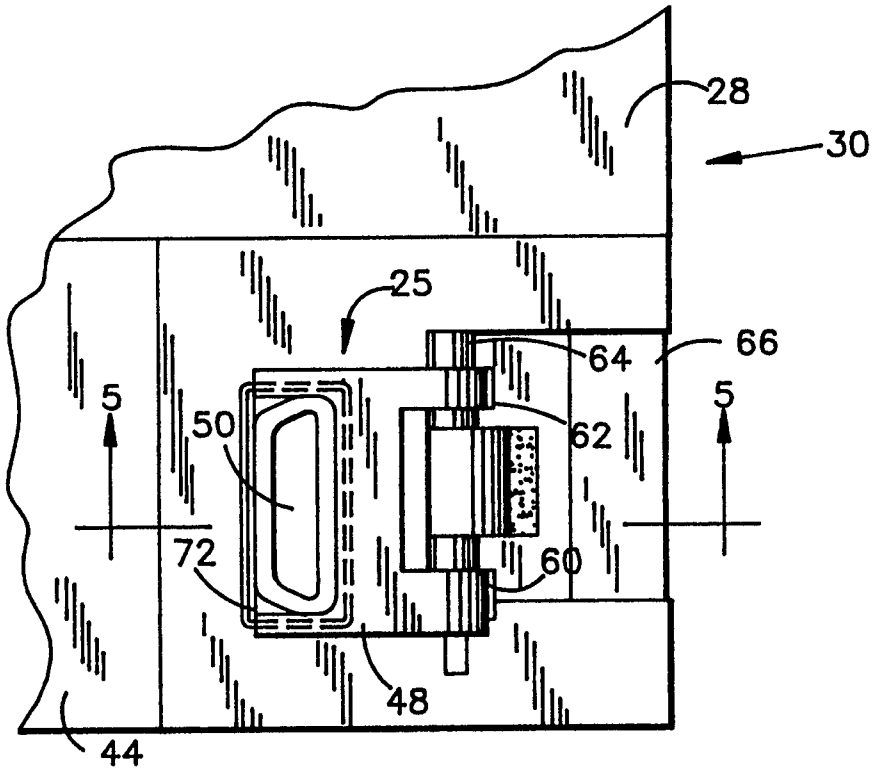
FIG. 4 is a top plan view of the integrated interbox connectors shown in FIGS. 2 and 3.
Figure 5:
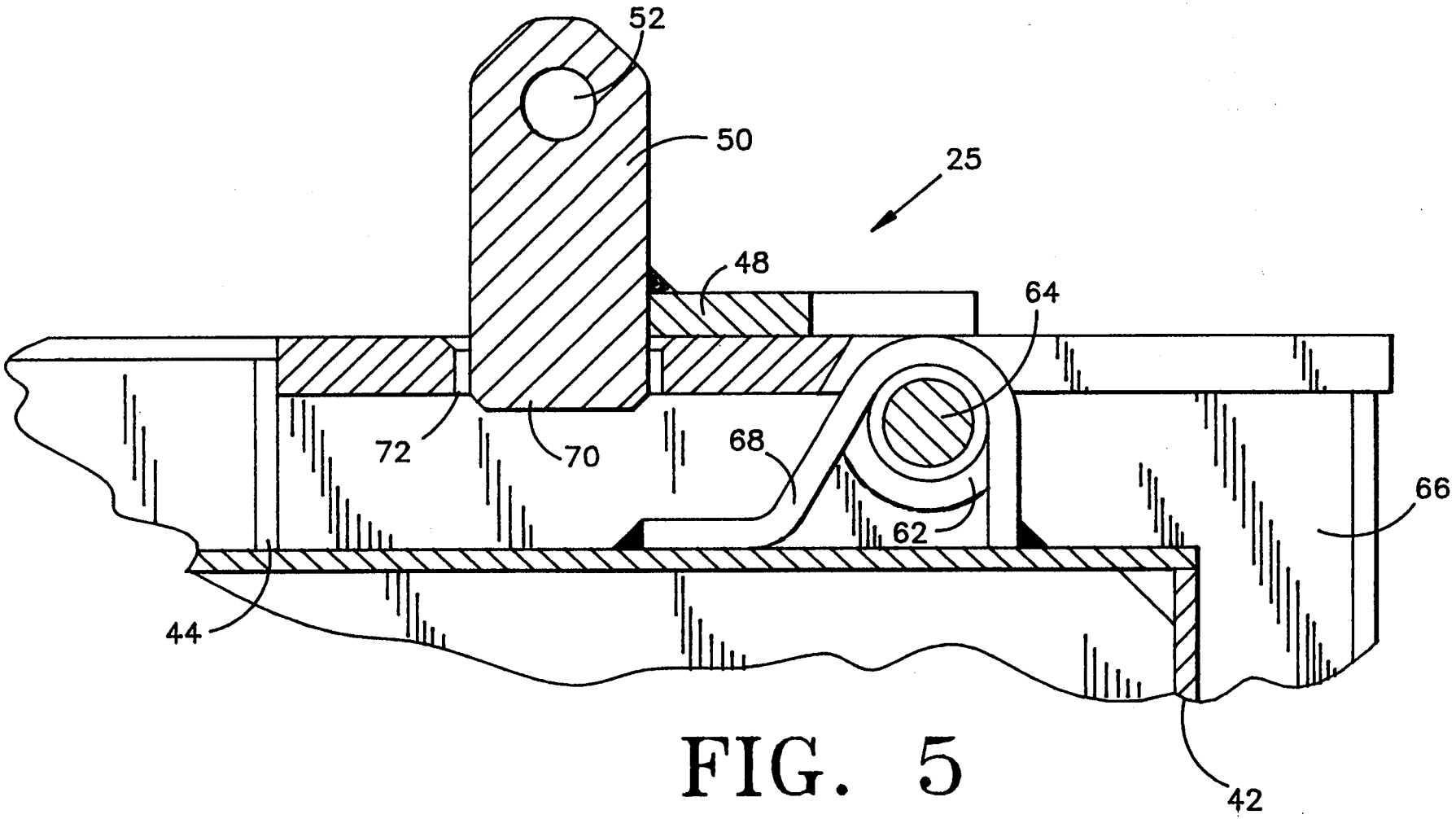
FIG. 5 is a sectional detail view taken along lines 5—5 shown in FIGS. 3 and 4.

The integrated interbox connector 25 shown to include a flat plate 48 to which is fixed an upwardly projecting lug 50 intended to be received in a downwardly facing chassis interlock aperture present in the rear sill of a vertically adjacent intermodal cargo container 22. The projecting lug 50 includes openings 52 and 54 which are sized and adapted to receive pin 56 which is secured to the upper end of the rear corner post 40 by chain 58. The projecting lug 50 includes a lower portion 70 as shown in FIGS. 5 and 6 defining a positioning lug which is adapted to be received in a positioning opening 72 as shown in FIGS. 4 and 5 to insure correct placement of the integrated interbox connector 25 for stacking.

A pair of collars 60 and 62 are fixed to plate 48 to define hinge elements adapted to receive hinge pin 64 which defines an axis of rotation about which the integrated interbox connector plate 48 and lug 50 rotate from the position shown in FIGS. 2–5 to a stored position in storage space 66. The pivot pin 64 is fixed to the top rear header 44 by pivot bracket 68. When not in use, the integrated interbox connecting plate 48 is displaced slightly forwardly and pivoted into the storage space 66. The pin 56 can then be inserted through opening 74 in the rear corner post 42 and into hole 52 to secure the integrated interbox connector 25 in the stored position within the outside geometry of the container.

FIGS. 7–10 illustrate the front integrated interbox connector 24 used at the front end 32 of the containers. The integrated interbox connector 24 comprises a plate 80 to which an upwardly projecting lug 82 is fixed and intended to be received in a downwardly facing opening in lower front casting 38. The lug 82 includes openings 84 and 86 adapted to receive locking pin 88 which is secured to the container by chain 90 fixed to an L-shaped bracket 92. The locking pin 88 includes a locking tab 89 for locking the pin 88 to a vertically adjacent container.

Figure 8:
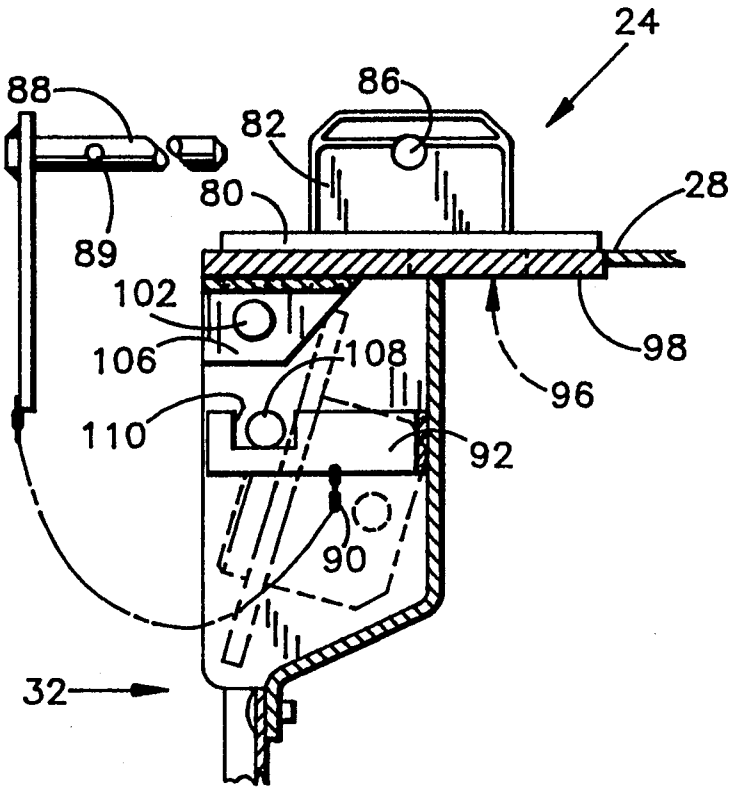
FIG. 8 is a sectional view taken along lines 8—8 of FIG. 7.
Figure 7:
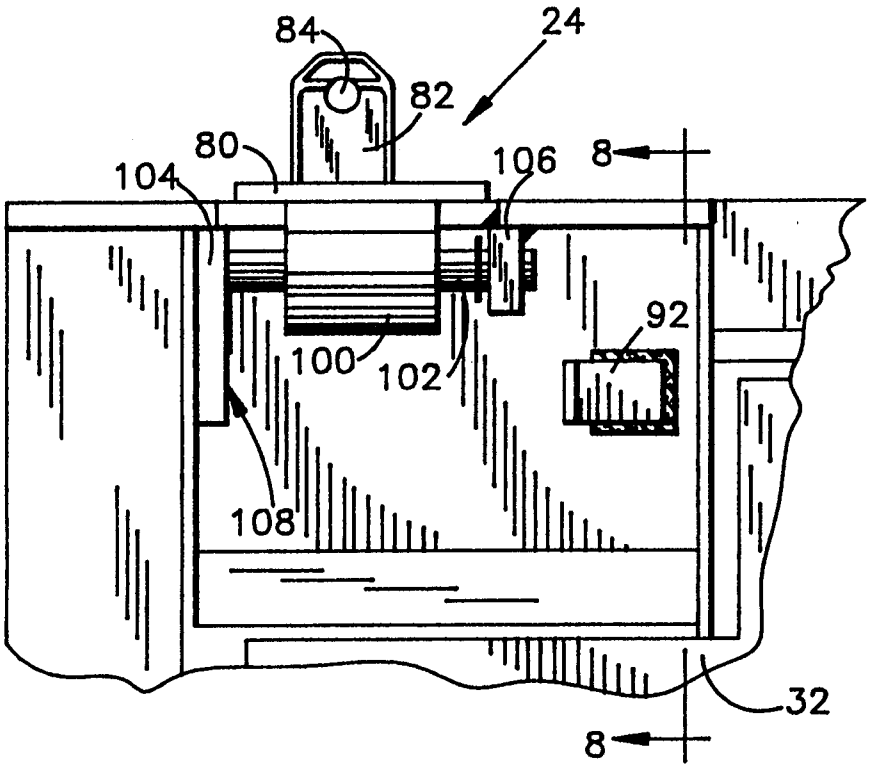
FIG. 7 is an elevation view of the upper left corner of the front of an intermodal container having an integrated interbox connector in accordance with the present invention.
Figure 10:
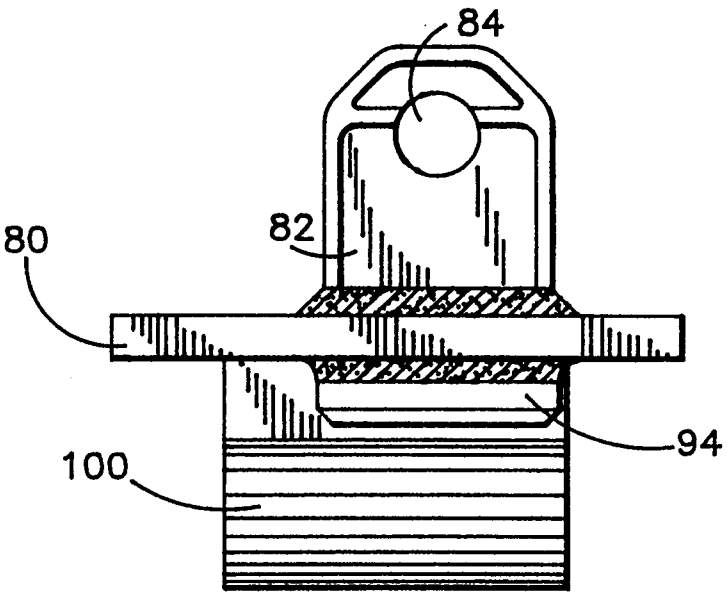
FIG. 10 is an elevational view of the weldment shown in FIG. 9 as viewed from the right side of FIG. 9.
Figure 9:
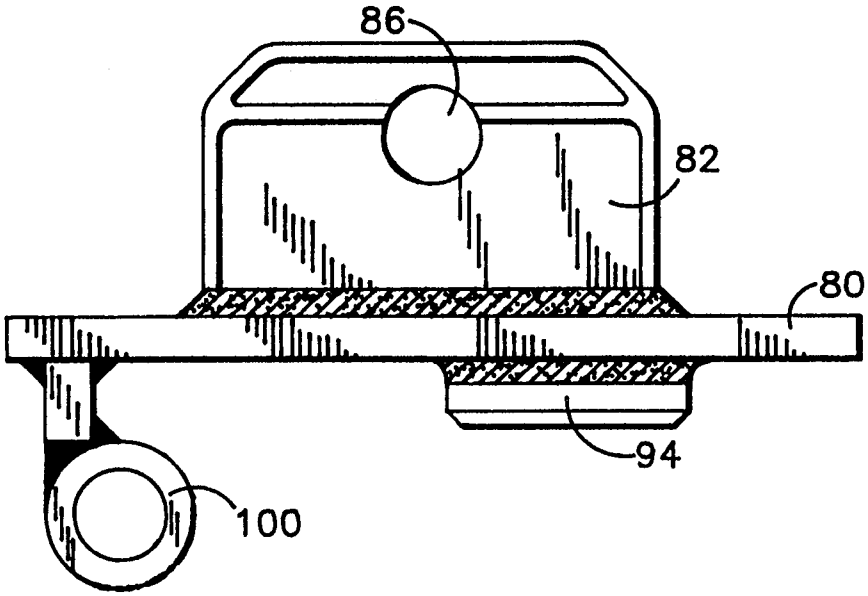
FIG. 9 is an elevational view of the interbox connector weldment shown in FIG. 8.

As shown in FIGS. 9 and 10, the interbox connector weldment includes a lower lug 94 which is adapted to be received in a positioning opening 96 in the top front header 98 which opening is shown in phantom in FIG. 8. The plate 80 is fixed to collar 100 which receives pivot pin 102 to define the hinge point about which the interbox connector 24 pivots from a stacking or use position, shown in FIG. 8 in full, to a storage position, shown in FIG. 8 in phantom. The axis of the hinge pin 102 is defined by hinge brackets 104 and 106. When the interbox connector is pivoted to its storage position shown in phantom in FIG. 8, the interbox connector is retained in that position by insertion of one end of pin 88 into opening 108 in a lower portion of bracket 104 and notch 110 in L-shaped bracket 92.

Figure 11:
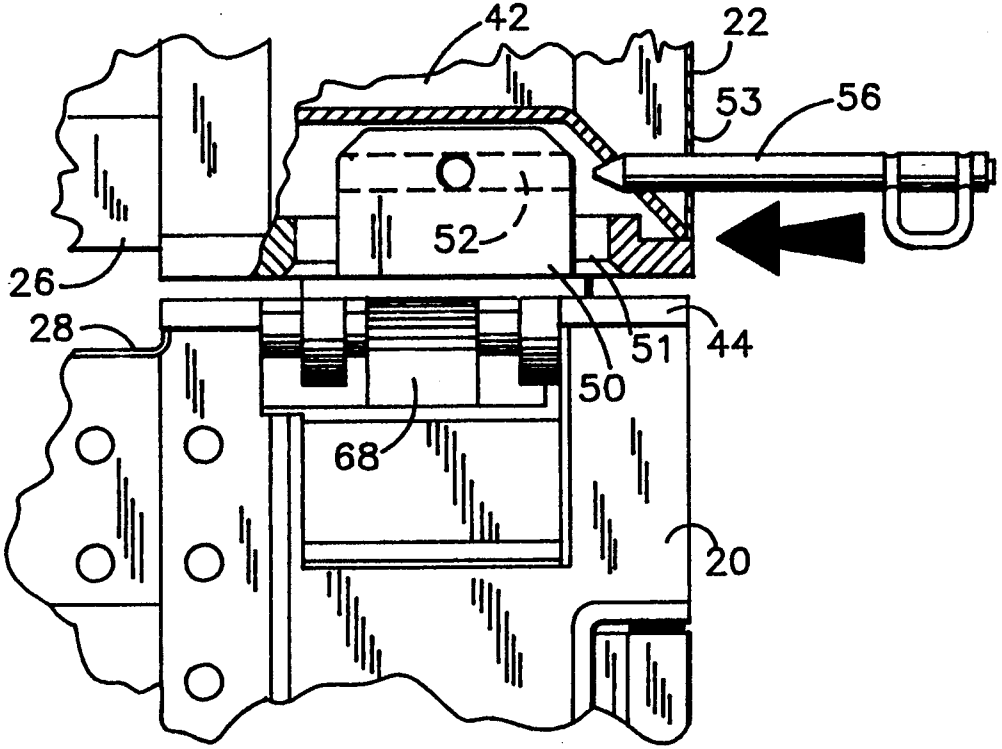
FIG. 11 is a side elevation view showing a rear integrated box connector coupled to a vertically adjacent container.
Figure 12:
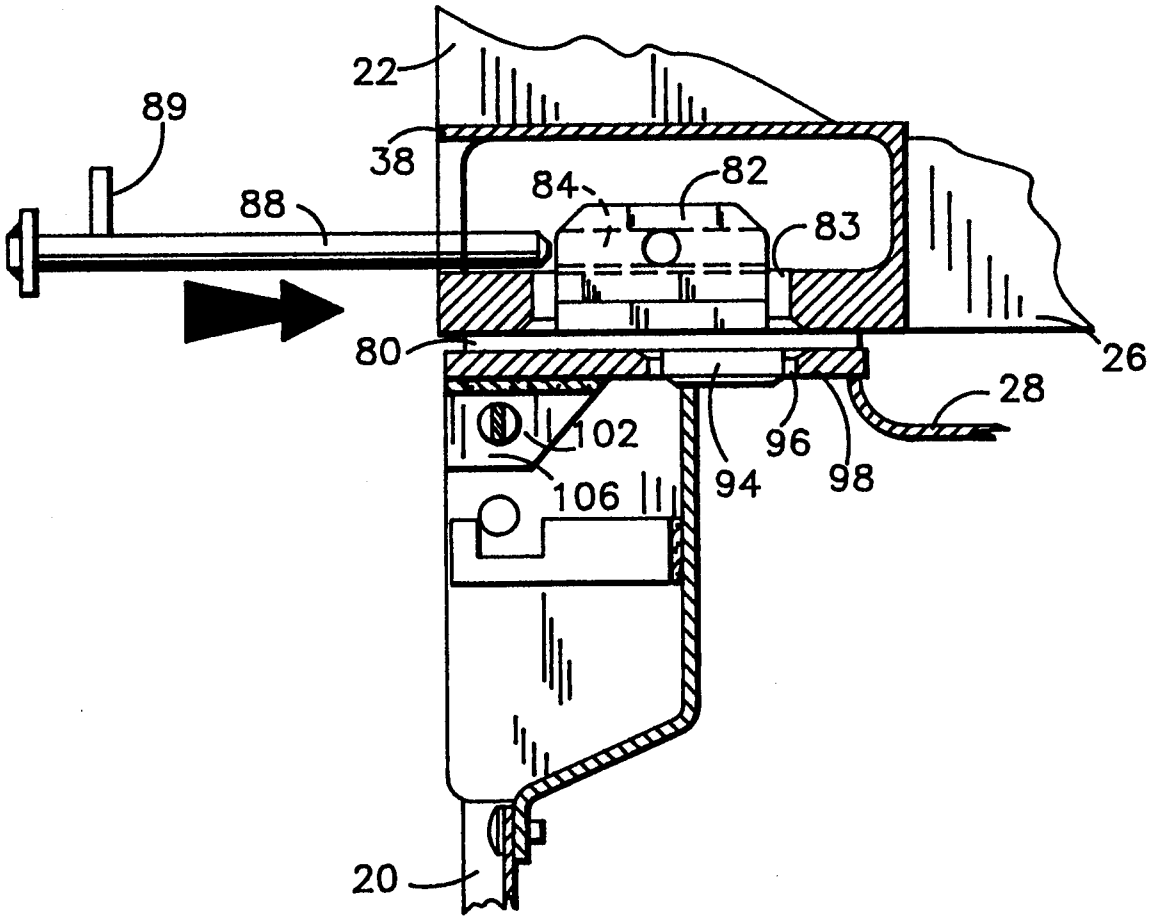
FIG. 12 is a sectional view showing a front integrated box connector coupled to a vertically adjacent container.

As shown in FIG. 11, the upwardly projecting lug 50 of rear interbox connector 25 is received in a downwardly facing rear chassis interlock aperture 51 present in the rear sill 53 of a vertically adjacent intermodal cargo container 22. The projecting lug 50 includes an opening 52 which is sized and adapted to receive pin 56 through a whole in the rear sill 53 of container 22. The upwardly projecting lug 82 of front interbox connector 24 is shown in FIG. 12 to be received in a downwardly facing opening 83 in lower front casting 38. The lug 82 includes an opening 84 adapted to receive locking pin 88 which includes a locking tab 89 for locking the pin 88 to a vertically adjacent container.

While the present disclosure shows fixed lugs 50 and 82, it will be appreciated that rotatable lugs might also be employed to enhance the interlocking engagement between the interbox connector lugs and the openings provided in the vertically adjacent container. Intermediate integrated interbox connectors similar to the rear connectors 25 could be employed at the 40 foot intermediate position, if combined with an appropriate stacking frame, to permit stacking of a smaller length container on top of an extended container as shown. Such intermediate integrated interbox connectors would not intrude significantly into the cargo space of the intermodal container incorporating them.

Although the invention has been described in detail with reference to the illustrated preferred embodiment, other variations and modifications exist within the scope and spirit of the invention as described and as defined in the following claims.

What is claimed is:

1. In an intermodal cargo container for carrying cargo, the container having a space enclosing structure including a floor, a roof, a pair of parallel side walls, and first and second end walls respectively connected between the side walls, with at least one of the side walls and end walls defining an opening therethrough to permit entry and exit of cargo, the improvement comprising integrated interbox connectors movably connected to the container and positionable between in a stored position situated within the space enclosing structure of the container and a connecting position situated on top of the roof of the container, and securing means for securing the interbox connectors to a vertically adjacent container.

2. The apparatus of claim 1 wherein the intermodal cargo container includes interlocking apertures located in the floor at corners defined by the intersection of the side walls and end walls, and said integrated interbox connectors connecting position being situated to engage the interlocking apertures of said vertically adjacent container.

3. The apparatus of claim 2 wherein each of said integrated interbox connectors includes a plate and a projecting lug fixed to the plate to project into said interlocking apertures of said vertically adjacent container.

4. The apparatus of claim 3 wherein each of said integrated interbox connectors includes a positioning opening in the roof of the container and a positioning lug fixed to said plate to be received in the positioning opening.

5. The apparatus of claim 3 wherein each of said integrated interbox connectors includes a first hinge element fixed to said plate and a second hinge element fixed to said container to permit pivotal displacement of the connector between said stored position and said connecting position.

6. The apparatus of claim 5 wherein each of said integrated interbox connectors includes a hinge pin coupling the first hinge element and the second hinge element.

7. The apparatus of claim 3 wherein each of said integrated interbox connectors includes at least one opening in said projecting lug and wherein said securing means comprises a pin insertable through an opening in said vertically adjacent container into the at least one opening in the projecting lug.

8. The apparatus of claim 7 wherein said pin includes a locking tab for locking the pin to the vertically adjacent container after insertion into said opening in the projecting lug.

9. The apparatus of claim 7 wherein each of said integrated interbox connectors includes a locking opening adapted to receive said pin for locking the interbox connector in said stored position.

10. Apparatus for engaging interlocking apertures provided on the bottom of intermodal cargo containers to permit vertical stacking of the containers, the cargo containers also having a floor, a roof, a pair of parallel side walls, and first and second end walls respectively connected between the side walls, with at least one of the side walls and end walls defining an opening therethrough to permit entry and exit of cargo, the apparatus comprising integrated interbox connectors movably connected to the containers and positionable between in a stored position situated within the walls of the container and a connecting position situated on top of the roof of the container to engage the interlocking apertures of a vertically adjacent container, and securing means for securing the interbox connectors situated in the connecting position to said interlocking apertures provided on the bottom of said vertically adjacent container.

11. The apparatus of claim 10 wherein each of said integrated interbox connectors includes a plate and a projecting lug fixed to the plate to project into said interlocking apertures of said vertically adjacent container, a positioning opening in the roof of the container and a positioning lug fixed to said plate to be received in the positioning opening.

12. The apparatus of claim 11 wherein each of said integrated interbox connectors includes at least one opening in said projecting lug and wherein said securing means comprises a pin insertable through an opening in said vertically adjacent container into the at least one opening in the projecting lug.

13. The apparatus of claim 12 wherein each of said integrated interbox connectors includes a first hinge element fixed to said plate, a second hinge element fixed to said container to permit pivotal displacement of the connector between said stored position and said connecting position, and a hinge pin coupling the first hinge element and the second hinge element.

14. The apparatus of claim 12 wherein said pin includes a locking tab for locking the pin to the vertically adjacent container after insertion into said opening in the projecting lug.

15. The apparatus of claim 12 wherein each of said integrated interbox connectors includes a locking opening adapted to receive said pin for locking the interbox connector in said stored position.

16. The apparatus of claim 12 wherein the intermodal cargo container includes interlocking apertures located in the floor at corners defined by the intersection of the side walls and end walls, said integrated interbox connectors connecting position being situated at the upper ends of said corners.

17. Apparatus for engaging interlocking apertures provided on the bottom of intermodal cargo containers to permit vertical stacking of the containers, the cargo containers also having a floor, a roof, a pair of parallel side walls, and first and second end walls respectively connected between the side walls, with at least one of the side walls and end walls defining an opening therethrough to permit entry and exit of cargo, the apparatus comprising a plate movably connected to the container, a positioning opening in the roof of the container and a positioning lug fixed to said plate to be received in the positioning opening to define a connecting position for the plate when situated on top of the roof of the container, a projecting lug fixed to the plate and adapted to project upward into one of said interlocking apertures of said vertically adjacent container when the plate is in the connecting position, at least one opening in said projecting lug and a pin insertable through an opening in said vertically adjacent container into the at least one opening in the projecting lug for securing the projecting lug to the interlocking apertures provided on the bottom of said vertically adjacent container, a chamber in the wall of the container, the positioning lug being movable to a position within the chamber defining a stored position situated within the walls of the container, said pin being movable to a position to lock the lug in said stored position.

18. The apparatus of claim 17 wherein said integrated interbox connector includes a first hinge element fixed to said plate, a second hinge element fixed to said container to permit pivotal displacement of the connector between said stored position and said connecting position, and a hinge pin coupling the first hinge element and the second hinge element.

19. The apparatus of claim 17 wherein said pin includes a locking tab for locking the pin to the vertically adjacent container after insertion into said opening in the projecting lug.

20. An intermodal cargo container assembly comprising a floor, a roof arranged in spaced apart parallel relationship above the floor, a pair of parallel side walls connecting the roof and the floor, first and second end walls respectively connected between the sidewalls, interlocking apertures provided on the bottom of the floor to permit vertical stacking of the container, and at least four integrated interbox connectors movably connected to the container adjacent the roof, each interbox connector comprising a plate movably connected to the container, a positioning opening in the roof of the container and a positioning lug fixed to said plate to be received in the positioning opening to define a connecting position for the plate when situated on top of the roof of the container, a projecting lug fixed to the plate and adapted to project upward into one of said interlocking apertures of said vertically adjacent container when the plate is in the connecting position, at least one opening in said projecting lug and a pin insertable through an opening in said vertically adjacent container into the at least one opening in the projecting lug for securing the projecting lug to the interlocking apertures provided on the bottom of said vertically adjacent container, a chamber in the wall of the container, the positioning lug being movable to a position within the chamber defining a stored position situated within the walls of the container, said pin being movable to a position to lock the lug in said stored position, a first hinge element fixed to said plate, a second hinge element fixed to said container to permit pivotal displacement of the connector between said stored position and said connecting position, and a hinge pin coupling the first hinge element and the second hinge element.

21. An intermodal cargo container assembly in accordance with claim 20 and further comprising a plurality of lift pockets fixed on said pair of parallel side walls adjacent to said roof adapted to receive a lift element for lifting the intermodal cargo container assembly into a stacked relationship.

22. The intermodal cargo container assembly of claim 21 wherein four of said lift pockets are positioned bilaterally symmetric with respect to each other, with two lift pockets on one of the side walls being matched by two corresponding lift pockets on the other side wall.

* * * * *

UNITED STATES PATENT AND TRADEMARK OFFICE

CERTIFICATE OF CORRECTION

PATENT NO. : 5,346,084

DATED : September 13, 1994

INVENTOR(S) : Howard J. Yurgevich

It is certified that error appears in the above-identified patent and that said Letters Patent is hereby corrected as shown below:

Title page, under the heading "United States Patent [19] and item [75] delete "Jurgevich" and insert therefor --Yurgevich--

Signed and Sealed this

Eighth Day of November, 1994

*Attest:*

*Attesting Officer*

Bruce Lehman

BRUCE LEHMAN

*Commissioner of Patents and Trademarks*